US010488825B2

(12) United States Patent
Park et al.

(10) Patent No.: US 10,488,825 B2
(45) Date of Patent: Nov. 26, 2019

(54) MOBILE TERMINAL MODULE AND WATCH TYPE MOBILE TERMINAL

(71) Applicant: LG ELECTRONICS INC., Seoul (KR)

(72) Inventors: Chanwook Park, Seoul (KR); Minbok Lee, Seoul (KR); Myungsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/671,916

(22) Filed: Aug. 8, 2017

(65) Prior Publication Data

US 2018/0314213 A1 Nov. 1, 2018

(30) Foreign Application Priority Data

Apr. 28, 2017 (KR) ..... 10-2017-0055024

(51) Int. Cl.
*G04G 17/04* (2006.01)
*G04G 17/08* (2006.01)

(52) U.S. Cl.
CPC ..... *G04G 17/045* (2013.01); *G04G 17/08* (2013.01)

(58) Field of Classification Search
CPC ..... G04B 39/00; G04B 39/025; G04B 17/04; G04B 17/045; G04B 17/08; G06F 1/163
See application file for complete search history.

(56) References Cited

U.S. PATENT DOCUMENTS 5,043,957 A * 8/1991 Kaelin ..... G04B 37/05 368/300
6,456,569 B1 * 9/2002 Stauffer ..... G04B 19/06 368/236
6,575,619 B1 * 6/2003 Stauffer ..... G04B 37/05 368/299

(Continued)

FOREIGN PATENT DOCUMENTS

AU 665966 B2 * 1/1996 ..... G04B 39/025
DE 202014008505 U1 12/2014

(Continued)

OTHER PUBLICATIONS

Takie, English Translation of JP11148981, originally published Jun. 2, 1999, retrieved from Espacenet on Sep. 4, 2018, full document (Year: 1999).*

(Continued)

*Primary Examiner* — Daniel P Wicklund
(74) *Attorney, Agent, or Firm* — Birch, Stewart, Kolasch & Birch, LLP

(57) ABSTRACT

A mobile terminal module has a display unit for displaying an image. A frame having the display unit disposed in an upper portion thereof has a first coupling portion. A bracket disposed in an upper portion of the display unit has a second coupling portion coupled to the first coupling portion to fix the display unit and the frame. A control board fixedly coupled to the frame or the bracket controls an operation of the display unit. A power supply unit fixedly coupled to the frame or the bracket supplies electric power to the display unit and the control board and a touch window fixed to an upper surface of the bracket recognizes a touch input.

13 Claims, 12 Drawing Sheets

(56) References Cited

U.S. PATENT DOCUMENTS

| | | | | |
|---|---|---|---|---|
| 6,791,905 | B1 * | 9/2004 | Sekiguchi | G04B 19/12 368/205 |
| 2003/0179326 | A1 * | 9/2003 | Kawata | G04G 9/00 349/58 |
| 2013/0148482 | A1 * | 6/2013 | Nagahama | G04C 10/02 368/205 |
| 2016/0161921 | A1 * | 6/2016 | Masaki | G04G 17/08 368/205 |
| 2016/0313593 | A1 * | 10/2016 | Grip | G02F 1/13452 |
| 2017/0010726 | A1 | 1/2017 | Huang et al. | |
| 2017/0185043 | A1 * | 6/2017 | Yuen | G04B 19/30 |

FOREIGN PATENT DOCUMENTS

| | | | | |
|---|---|---|---|---|
| EP | 2284948 | A1 | | 2/2011 |
| EP | 2887201 | A2 | | 6/2015 |
| JP | 11148981 | A | * | 6/1999 |
| JP | 2005-57426 | A | | 3/2005 |
| JP | 2015-230167 | A | | 12/2015 |
| KR | 10-2015-0121831 | A | | 10/2015 |
| WO | WO 2009/097182 | A1 | | 8/2009 |
| WO | WO 2017/026868 | A1 | | 2/2017 |

OTHER PUBLICATIONS

ETA SA, English Translation of DE 202014008505, originally published Dec. 31, 2014, full document (Year: 2014).*

* cited by examiner

MOBILE TERMINAL MODULE AND WATCH TYPE MOBILE TERMINAL

CROSS-REFERENCE TO RELATED APPLICATIONS

This application claims priority to Korean Patent Application No. 10-2017-0055024 filed on Apr. 28, 2017 in Korea, the entire contents of which is hereby incorporated by reference in its entirety.

BACKGROUND OF THE DISCLOSURE

Field of the Disclosure

Embodiments of the present disclosure relate to a mobile terminal module and a watch type mobile terminal, more particularly, a mobile terminal module and a watch type mobile terminal which is easy to be assembled to an assembly (an assy) by fixedly coupling each of components.

Background of the Disclosure

Mobile terminals are hand-carry devices having diverse functions. More specifically, Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

To realize such diverse functions quickly and efficiently, various techniques are applied to the mobile terminals in terms of software or hardware programs. For instance, the mobile terminals are provided with user interface environments for users to search or select functions easily and conveniently.

A conventional mobile terminal is fabricated in a size which is able to be grabbed by a user in the hand or kept in a pocket. However, there is some room for risks of breaks or damage which can occur when the conventional mobile terminal is kept in the pocket or in the hand. Accordingly, watch type mobile terminals which can be worn on the wrists like wrist watches are presented in recent.

In general, mobile or watch manufacturers directly manufacture assys and load or assemble components to the assys, to manufacture watch type mobile terminals. However, as such a watch type mobile terminal is regarded as a personal belonging, diverse exterior deigns are often applied to the watch type mobile terminal. A design company specialized only in exterior designs fabricates assys diverse exterior designs are applied. The mobile terminal or watch manufactures are supplied the assys (or assemblies) and assemble components to the assys (the assemblies).

In recent instances, such design companies not only fabricate the assys but also manufacture and sell watch type mobile terminals by direct marketing. However, it is difficult to assemble components to the assy of the conventional watch type mobile terminal. Accordingly, such the design companies have to incur the cost of request for assembling on a watch manufacturer or additional assembly lines.

SUMMARY OF THE DISCLOSURE

Accordingly, an object of the present invention is to address the above-noted and other problems.

An object of the present disclosure is to provide a mobile terminal module and a watch type terminal which is easy to be assembled by fixedly coupling the other components, except an assy.

Additional features of the present disclosure will be set forth in the description which follows, and in part will be apparent from the description, or may be learned by practice of the disclosed subject matter.

Embodiments of the present disclosure may provide a mobile terminal module comprising a display unit for displaying an image; a frame having the display unit disposed in an upper portion thereof and comprising a first coupling portion; a bracket disposed in an upper portion of the display unit and comprising a second coupling portion coupled to the first coupling portion to fix the display unit and the frame; a control board fixedly coupled to the frame or the bracket and configured to control an operation of the display unit; a power supply unit fixedly coupled to the frame or the bracket and configured to supply electric power to the display unit and the control board; and a touch window fixed to an upper surface of the bracket and configured to recognize touch input.

One of the first and second coupling portions may be formed as a hook and the other one is formed as a hooking portion to which the hook is hooked.

The first coupling portion may be formed in a lateral surface of the frame.

The bracket may comprise at least one guide portion extended from an outer surface downward, and a slot may be formed in a lateral surface of the frame and corresponding to the guide portion in the size and the shape, and the bracket may be coupled to an upper portion of the display unit as the guide portion is inserted in the slot.

At least one boss may be projected from an upper surface of the frame upward, and a boss groove may be recessed from a lower surface of the bracket and corresponding to the boss in the size and the shape, and the frame may be coupled to an upper portion of the display unit as the boss is inserted in the boss groove.

The mobile terminal module may further comprise hands disposed in an upper portion of the display unit and configured to move to point to the current time as time passes; and a drive unit configured to supply a drive power to the hands.

The distance or height from the upper surface of the display unit to the touch window may be larger than that of the connecting portion for connecting the hands to the drive unit.

At least one first reference portion may be displayed on an upper surface of the touch window, and at least one second reference portion may be formed in an upper surface of the bracket, and the touch window may be fixedly coupled to the upper surface of the bracket as the first reference portion is located in a corresponding position to the second reference portion.

The mobile terminal module may further comprise a display tape disposed between the bracket and the display unit and having adhesiveness which is provided in both surfaces thereof.

The mobile terminal module may further comprise a display tape disposed between the touch window and the bracket and having adhesiveness which is provided in both surfaces thereof.

Embodiments of the present disclosure also provide a watch type mobile terminal comprising a mobile terminal module comprising a display unit for displaying an image; a frame having the display unit disposed in an upper portion thereof and comprising a first coupling portion; a bracket disposed in an upper portion of the display unit and comprising a second coupling portion coupled to the first coupling portion to fix the display unit and the frame; a control board fixedly coupled to the frame or the bracket and configured to control an operation of the display unit; a power supply unit fixedly coupled to the frame or the bracket and configured to supply electric power to the display unit and the control board; and a touch window fixed to an upper surface of the bracket and configured to recognize touch input; a first housing comprising an accommodating space for accommodating the mobile terminal module; a second housing coupled to the first housing and covering the accommodating space; and a strap connected to the first housing and winding a user's specific body part.

The first coupling portion may be formed in a lateral surface of the frame.

The bracket may comprise at least one guide portion extended from an outer surface downward, and a slot is formed in a lateral surface of the frame and corresponding to the guide portion in the size and the shape, and the bracket is coupled to an upper portion of the display unit as the guide portion is inserted in the slot.

At least one boss may be projected from an upper surface of the frame upward, and a boss groove may be recessed from a lower surface of the bracket and corresponding to the boss in the size and the shape, and the frame may be coupled to an upper portion of the display unit as the boss is inserted in the boss groove.

The watch type mobile terminal may further comprise hands disposed in an upper portion of the display unit and configured to move to point to the current time as time passes; and a drive unit configured to supply a drive power to the hands, wherein the distance or height from the upper surface of the display unit to the touch window is larger than that of the connecting portion for connecting the hands to the drive unit.

Specific details of the embodiments are included in description of specific embodiments and the accompanying drawings.

According to at least one embodiment mentioned above, there are following effects.

The components are fixedly coupled to each other to be one module, so that the watch type mobile terminal can be assembled easily by one simply process of inserting the module terminal module in the assembly.

A watch type mobile terminal manufacturer is supplied only the mobile terminal module, not the components separately, so that the manufacturer can transfer and keep and maintain the components.

Furthermore, the user having purchased the watch type mobile terminal is able to dissemble only the assay and assemble it to another assy, so as to change the current design into a new desired design.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Figure 1:
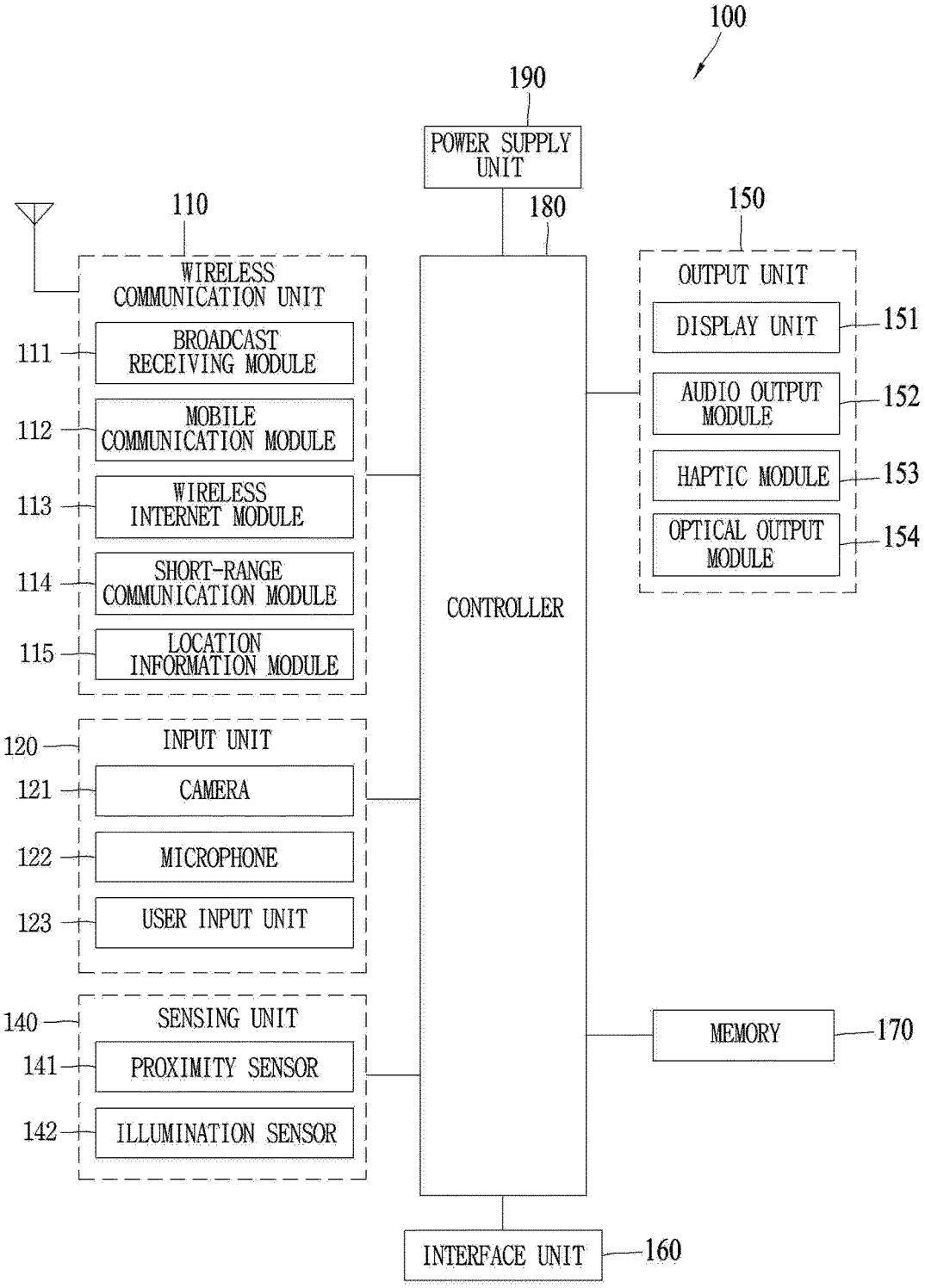
FIG. 1 is a block diagram of a mobile terminal in accordance with the present disclosure.

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra-books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

FIG. 1 is a block diagram of a mobile terminal in accordance with the present disclosure.

The mobile terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components in The FIG. 1 is not a requirement, and that greater or fewer components may alternatively be implemented.

Referring now to FIG. 1, the mobile terminal 100 is shown having wireless communication unit 110 configured with several commonly implemented components.

The wireless communication unit 110 typically includes one or more modules which permit communications such as wireless communications between the mobile terminal 100 and a wireless communication system, communications between the mobile terminal 100 and another mobile terminal, communications between the mobile terminal 100 and an external server. Further, the wireless communication unit 110 typically includes one or more modules which connect the mobile terminal 100 to one or more networks. To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the mobile terminal, the surrounding environment of the mobile terminal, user information, and the like. For example, in FIG. 1, the sensing unit 140 is shown having a proximity sensor 141 and an illumination sensor 142.

If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The mobile terminal 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154.

The display unit 151 may have an inter-layered structure or an integrated structure with a touch sensor in order to facilitate a touch screen. The touch screen may provide an output interface between the mobile terminal 100 and a user, as well as function as the user input unit 123 which provides an input interface between the mobile terminal 100 and the user.

The interface unit 160 serves as an interface with various types of external devices that can be coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically functions to control overall operation of the mobile terminal 100, in addition to the operations associated with the application programs. The controller 180 processes signals, data, information and the like inputted or outputted through the above-mentioned components and/or runs application programs saved in the memory 170, thereby processing or providing a user with appropriate information and/or functions.

The controller 180 may provide or process information or functions appropriate for a user by processing signals, data, information and the like, which are input or output by the various components depicted in FIG. 1, or activating application programs stored in the memory 170. As one example, the controller 180 controls some or all of the components illustrated in FIGS. 1-1C according to the execution of an application program that have been stored in the memory 170.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

At least one portion of the respective components mentioned in the foregoing description can cooperatively operate to embody operations, controls or controlling methods of the mobile terminal according to various embodiments of the present invention mentioned in the following description. Moreover, the operations, controls or controlling methods of the mobile terminal can be embodied in the mobile terminal by running at least one or more application programs saved in the memory 170.

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

As used herein, the suffixes 'module', 'unit' and 'part' are used for elements in order to facilitate the disclosure only. Therefore, significant meanings or roles are not given to the suffixes themselves and it is understood that the 'module', 'unit' and ' part' can be used together or interchangeably.

Meanwhile, the mobile terminal 100 may be expanded to be a wearable device which is able to be worn on the human body, after going beyond the hand-carry type which is able to be held in the hand by the user. Such a wearable device may include a smart watch, a smart glass, HMD (head mounted display) and the like.

The mobile terminal 100 in accordance with one embodiment may be realized as such a wearable device, especially, a watch type mobile terminal (for example, a smart watch). Hereinafter, examples of the watch type mobile terminal 100 will be described.

The watch type mobile terminal 100 may transceive or link data with another mobile terminal 100. A short range communication module 114 may sense or recognize the watch type mobile terminal 100 which is communicable nearby in a short range. Moreover, in case the watch type mobile terminal 100 is a device with communication certification with respect to the other mobile terminal 100, for example, a smart phone, the watch type mobile terminal 100 may receive some of the data treated in the other mobile terminal 100 such as the smart phone via the short range communication module 114.

Accordingly, the user is able to use the data treated in the mobile terminal 100 such as the smart phone through the watch type mobile terminal 100. For example, when the mobile terminal 100 such as the smart phone receives a call, the user may receive the call by using the watch type mobile phone 100. When there is a message received in the mobile terminal 100 such as the smart phone, the user is able to check and identify the message through the watch type mobile terminal 100.

Each of the components provided in the watch type mobile terminal 100 mentioned above may be realized as the software program such as task, class, sub-routine, process, object, threads of execution or hardware programs such as FPGA (Field-Programmable Gate Array) or ASIC (Application-Specific Integrated Circuit), or combination of the software and hardware programs. The components may be provided in a computer readable storage media or some of them may be distributed in a plurality of computers.

Each of the blocks may present a module or some of a segment or code which includes one or more executable instructions for executing specific logical function(s). In some substitution execution embodiments, the functions mentioned in the blocks may be implemented out of order. For example, two of the blocks which are arranged in order can be substantially performed at the same time and the blocks may be performed in the reverse order according to corresponding functions.

Figure 2:
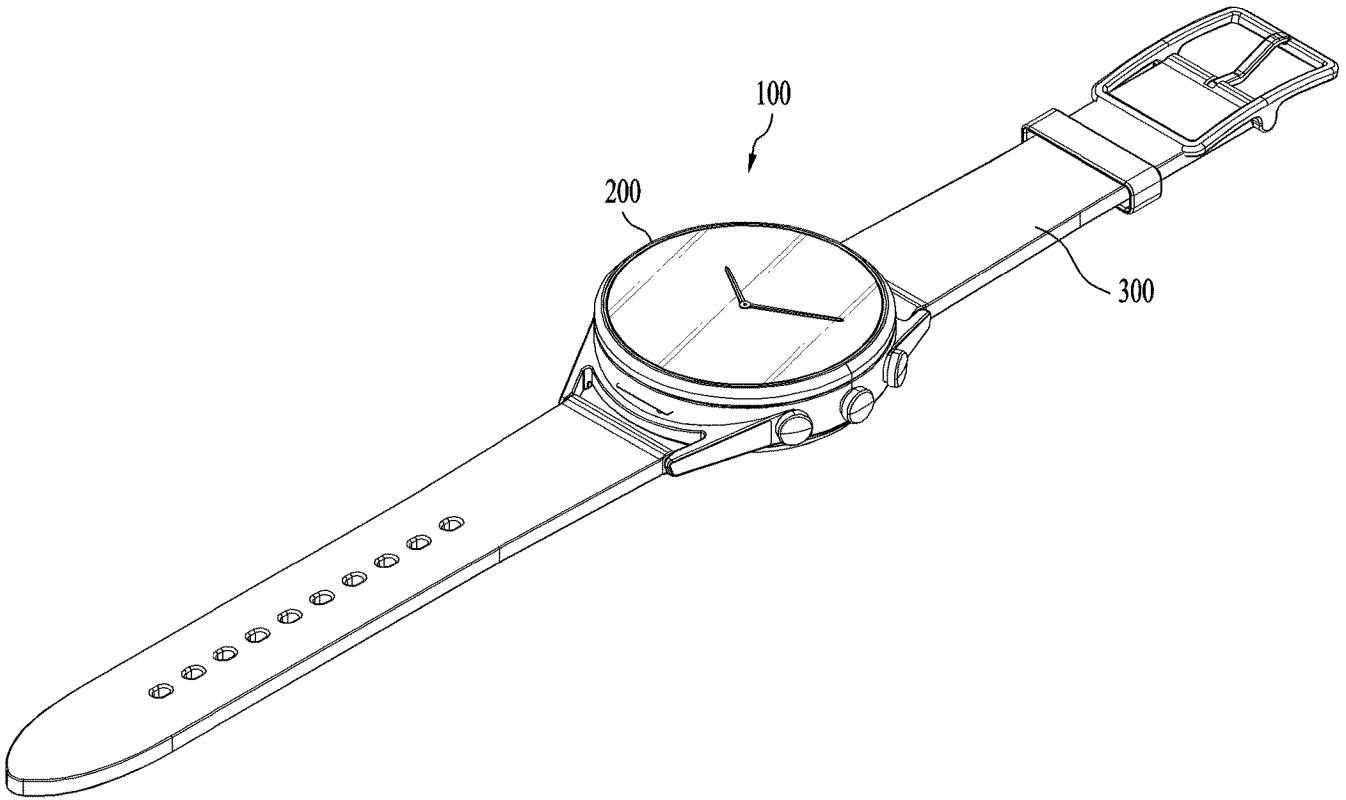
FIG. 2 is a perspective diagram illustrating a watch type mobile terminal in accordance with one embodiment.
Figure 3:
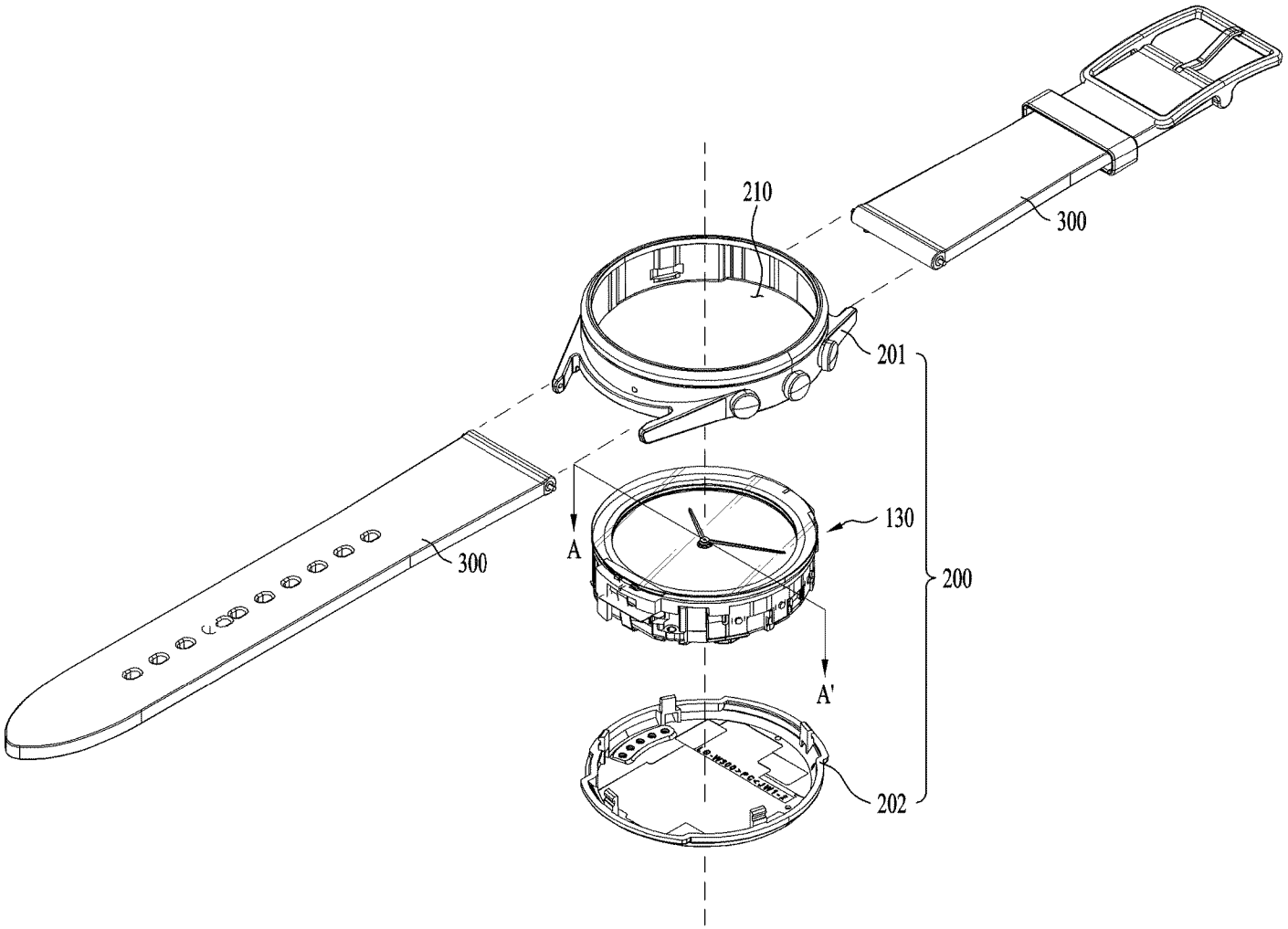
FIG. 3 is a diagram illustrating an assembling process of the watch type mobile terminal in accordance with one embodiment.

FIG. 2 is a perspective diagram illustrating the watch type mobile terminal 100 in accordance with one embodiment and FIG. 3 is a diagram illustrating an assembling process of the watch type mobile terminal 100 in accordance with one embodiment.

Hereafter, structural characteristics of the watch type mobile terminal 100 will be described, as shown in FIGS. 2 and 3, the watch type mobile terminal 100 includes a mobile terminal module 130 for implementing diverse functions of the mobile terminal mentioned above; an assy (assembly 200) accommodating the mobile terminal module 130 and defining an exterior design of the watch type mobile terminal 100; and a strap 300 connected to the assy 200 to be worn on the user's wrist.

The mobile terminal module 130 is modulated as one module by fixedly coupling the components mentioned above to each other. The watch type mobile terminal 100 may be easily assembled by inserting only the mobile module 130 to the assy 200. The mobile terminal module 130 will be described in detail later.

An internal space is formed in the assy 200 and the mobile terminal module 130 may be mounted in the internal space. The assy 200 includes a front assy 201 and a rear assy 202. The internal space may be formed in at least one of the front and rear assys 201 and 202. However, the embodiments of the present disclosure are not limited thereto and only one assy 200 is provided to realize uni-body watch type mobile terminal. Only if having the internal space capable of accommodating the mobile terminal module 130, the assy 200 may be formed in diverse shaped.

One or more specific components may be loaded in one surface of the rear assy 202. For example, USIM or memory card and the like for using the watch type mobile terminal 100 may be loaded in the surface of the rear assy 202. In this instance, a ground or line connected to the mobile terminal module 130 may be loaded in the other surface of the rear assy 202. Accordingly, data or signals may be transceived between the USIM or memory cards and the mobile terminal module 130.

The rear assy 202 may further include a rear cover for protecting the surface in which the components are loaded. The rear cover has a predetermined structure for the user to couple or decouple easily. When the user decouples the rear cover, the surface of the rear assy 202 is exposed outside and the user is able to replace the USIM or memory card easily.

The assy 200 may be fabricated by injecting synthetic resin or made of metal such as stainless steel (STS) or titanium (Ti). However, not limited thereto, it may be made of diverse materials such as plastic, glass and the like only if diverse exterior designs are able to be applied.

The watch type mobile terminal 100 is able to implement wireless communication and it may further include an antenna for wireless communication. Meanwhile, the antenna may have expanded functions by using the assy 200. For example, the assy 200 including a conductive material is electrically connected with the antenna to expand the ground region or irradiation region.

The internal space shown in FIG. 3 may be formed in the front assy 201. Accordingly, the mobile terminal module 130 is inserted in the internal space of the front assy 201 and the rear assy 202 is coupled to a lower surface of the front assy 201, only to cover the lower surface of the front assy 201 and prevent the separation of the mobile terminal module 130. Alternatively, not limited thereto, the internal space may be formed in the rear assy 202. In this instance, the front assy 201 is coupled to an upper surface of the rear assy 202, only to cove the upper surface of the rear assy 202 and prevent the separation of the module terminal module 130.

A window hole 210 may be formed in one surface of the front assy 201 to expose a touch window 131 of the mobile terminal module inserted in the internal space. The window hole 210 has to be wide enough to allow the user to apply touch input to the touch window 131 easily. If the window hole is too wide, the mobile terminal module 130 might be separated from the assy 200. If it is too narrow, the user's touch input might be interfered with. Accordingly, the width of the window hole 210 may be determined diversely according to the size and shape of the mobile terminal module 130 and those of the assy 200. An optimal width for facilitating the user's touch input and preventing the separation of the mobile terminal module 130 is substantially determined based on experiments.

The strap 300 is connected with the assy 200, to enable the user's wearing of the watch type mobile terminal 100 on the wrist. The strap 300 has a band shape to surround the user's wrist in contact. At this time, the length of the strap 300 is variable to be easily wearable on the wrists with various widths and thicknesses. To enhance the user's wearing sensation, the strap 300 may be made of a flexible material such as leather, rubber, silicon, synthetic resin and the like. Not limited thereto, the strap 300 may be formed by a plurality of metal parts having rings connected in series as on strap. Alternatively, the strap 300 may be detachably connected with the assy 200 to be replaced with another strap 300 by the user according to the personal preference.

Meanwhile, the strap 300 may be used in expanding the functions of the antenna. For example, a ground expansion unit (not shown) electrically connected with the antenna may be embedded in the strap 300 to expand the ground region.

The strap 300 may include a fastener. The fastener may be realized as a buckle, a snap-fit structure or Velcro and it may include a flexible region or material.

Figure 4:
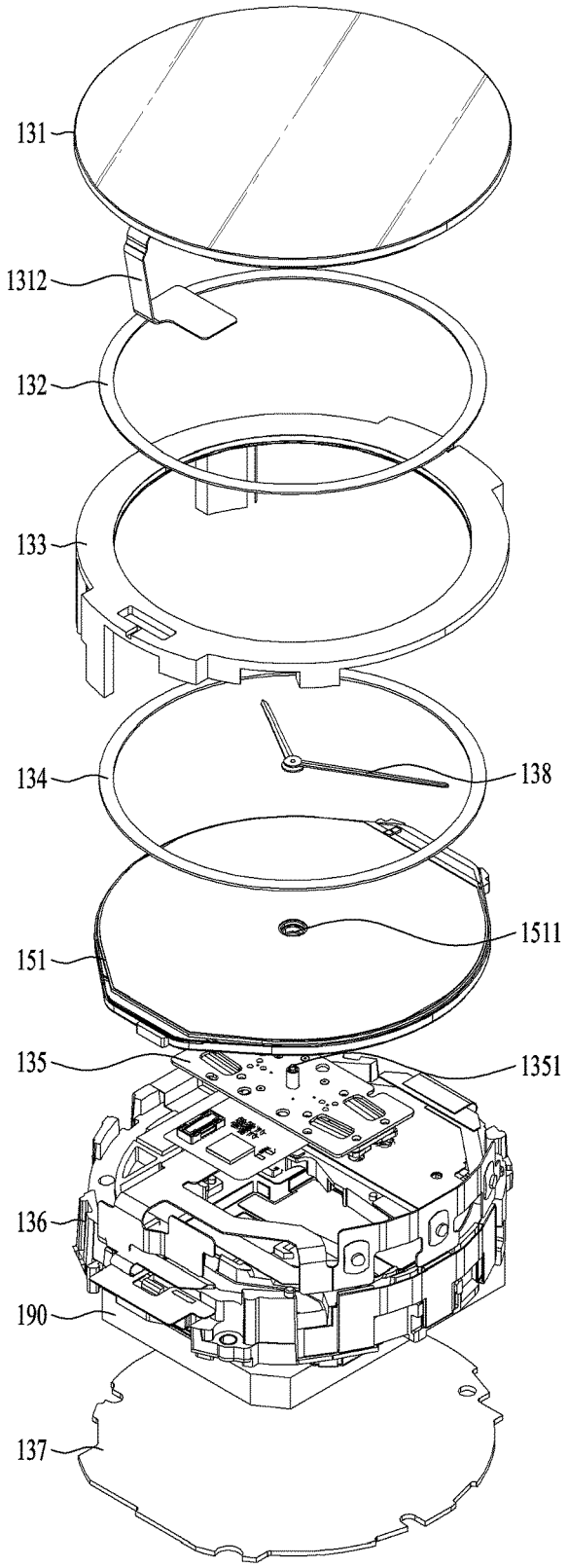
FIG. 4 is a diagram illustrating an assembling process of a mobile terminal module in accordance with one embodiment.

FIG. 4 is a diagram illustrating an assembling process of the mobile terminal module 130 in accordance with one embodiment.

The mobile terminal module 130 in accordance with the illustrated embodiment shown in FIG. 4 includes a display unit 151; a frame 136; a bracket 133, a power supply unit 190 and a control board 137.

The display unit 151 is configured to display the information which is treated in the watch type mobile terminal 100, as mentioned above. The display unit 151 may include a touch sensor for sensing touch on the display unit 151 so as to be supplied a control command in a touch method.

The touch sensor may be configured to covert variation of the capacitance generated in a specific region of the display unit 151 or the pressure applied to a specific region into an electrical input signal. The touch sensor may be also configured to detect the not only location and area of the touched region but also the pressure applied by the touch when touch input is applied to the display unit 151, the touch sensor senses the touch input and the control unit 180 generates a control signal corresponding to the touch based on the sensed touch input. The contents input by a touch manner may be letters or numbers or a menu list commanded or designated in various modes.

At this time, the display unit 151 may be structured to be a mutual layer structure with the touch sensor or integrally formed with the touch sensor, to realize a touchscreen. For example, the touch sensor may be arranged on a circuit board of the display or loaded in the display. Such the touchscreen may function as the user input unit 123 for providing an input interface between the mobile terminal 100 and the user and supply an output interface between them.

However, if the watch type mobile terminal 100 includes hands 138 for physically indicating the current time, the hands 138 are installed beyond the display unit 151. The window 131 is covered over the hands 138 to prevent a physical external shock applied to the hands from changing the time indicated by the hands. In this instance, the user is not able to apply touch input to the display unit 151 directly. Accordingly, the touch sensor may be integrally formed with the window 131, not the display unit, to realize the touch window 131.

The frame 136 is corresponding to a body of the mobile terminal module 130. The other components of the mobile terminal module 130, especially, the display unit 151, the power supply unit 190 and the control board 137 are coupled with respect to the frame 136. According to the embodiment shown in FIG. 4, the display unit 151 may be disposed on an upper portion of the frame 136 and the control board 137 in a lower portion of the frame 136. The power supply unit 190 may be disposed in an inner portion of the frame 136. Not limited thereto, the control board 137 may be disposed in the upper portion of the frame 136 and the power supply unit 190 may be disposed in an outer portion of the frame 136, as alternative example. However, it is preferred that the display unit 151 is coupled to the upper portion of the frame 136, because it has to output image information outside.

The bracket 133 is disposed over the display unit 151 and configured to fixedly couple the frame 136 and the display unit 151 to each other. At least one first coupling portion 1361 (see FIG. 7) is formed in a lateral surface of the frame 136 and a second coupling portion (1331, see FIG. 5) is formed in the bracket 133. As the first coupling portion 1361 and the second coupling portion 1331 are coupled to each other, the bracket 133 is coupled to the frame 136. The detailed description about the bracket 133 will be made later.

The power supply unit 190 is configured to supply electric power to each of the components provided in the watch type mobile terminal 100 as mentioned above. The power supply unit 190 shown in FIG. 4 may be provided in the inner portion of the frame 136.

The control board 137 is a physical board physically realized as the control unit 180 mentioned above. In other words, when receiving an input signal from the diverse sensors, the control board 137 implements corresponding operations according to the input signal and controls the components. Such the control board 137 may include CPU (Central Processing Unit), MCU (Micro Controller Unit), DSP (Digital Signal Processor) and other various logical operation processors.

The mobile terminal module 130 shown in FIG. 4 may further include a touch window 131, hands 138, a drive unit 135, a window tape 132 and a display tape 134.

The touch window 131 is disposed over the mobile terminal module 130 to cover the hands 138 and the display unit 151 as mentioned above. The touch window 131 is spaced a preset distance a part from the display unit 151. Accordingly, a predetermined space is defined between the touch window 131 and the display unit 151 and the hands 138 are configured to move in the predetermined space to point to the current time in real time.

A touch sensor for recognizing the user's touch input is integrally formed with the touch window 131. When the user applies touch input to the touch window 131, an electrical signal is generated. A signal transmitting portion 1312 is formed adjacent to a predetermined region of the touch window 137 to transmit such the electrical signal to the control board 137.

The signal transmitting portion 1312 may include a FPCB (Flexible Printed Circuit Board) and a plurality of lines which are mounted in the FPCB. The signal transmitting portion 1312 has flexibility because of the FPCB, with a thin plate shape. Accordingly, the user is able to bend the signal transmitting portion 1312 freely. A signal transmitting portion hole is formed in a predetermined region of the bracket 133 to insert the signal transmitting portion 1312 therein. The signal transmitting portion hole 1336 may be formed in the region corresponding to the signal transmitting portion 1312 when the touch window 131 and the bracket 133 are bonded to each other, accordingly, when bonding the touch window 131 to the bracket 133, the user is able to insert the signal transmitting portion 1312 formed in the touch window 131 in the signal transmitting portion hole 1336 formed in the bracket 133 easily. The signal transmitting portion 1312 is extended downward in contact with the lateral surface of the frame 136 and one end of the signal transmitting portion 1312 is then connected to the control board 137. To facilitate the user's assembling, one end of the signal transmitting portion 1312 may be connected to a lower surface of the control board 137.

The signal transmitting portion 1312 includes the plurality of the lines and the electrical signal generated in the touch window 131 is transmitted to the control board 137 via the lines. Hence, the control board 137 is provided with the electrical signal and implemented to perform the corresponding operation to the applied touch input.

As mentioned above, a central portion is hollow in the front assy 201 and the window hole (210, see FIG. 3) is formed in the central portion. When the mobile terminal module 130 is inserted in the internal space of the assy 200, the touch window 131 is exposed outside via the window hole 210 to facilitate the user's touch input. Not limited thereto, the touch window 131 may be coupled to not the mobile terminal module 130 but the front assy 210 as another example, unless the mobile terminal module 130 includes the hands 138. Or, the display unit 151 may be directly exposed outside, without the touch window 131. In other words, diverse methods may be applied only when the user is allowed to apply the touch input to the mobile terminal module 130 easily. Without the touch window 131, there is no signal transmitting portion 1312 for transmitting the signal of the touch window 131 and no signal transmitting portion hole 1336 formed in the bracket 133 to insert the signal transmitting portion 1312 therein. More specifically, the mobile terminal module 130 in accordance with the illustrated embodiment is not limited but formed in various shapes according to the presence of the hands 138.

The hands 138 are located over the display unit 151 and configured to move according as time passes so as to point to the current time. The hands 138 include an hour hand and a minute hand. It may further include a second hand. Only when the mobile terminal module 130 includes the hands 138 as mentioned above, the touch window 131 is spaced a predetermined distance apart from the display unit 151 and a predetermined space is formed between them. Accordingly, the hands 138 are configured to move within the predetermined space.

Like a conventional clock, the hands 138 may perform circular movement with respect to the center of the mobile terminal module 130. At this time, the center of the display unit 151 is penetrated to form the display hole 1511. When the display unit 151 is coupled to the frame 136, a connecting portion 1351 is projected from the display unit 151 upward, penetrating the display hole 1511. The hands 138 are connected to the connecting portion 1351, over the display unit 151, to be connected to the drive unit 135 located under the display unit 151.

The drive unit 135 is supplied the electric power from the power supply unit 190 to create the drive power for moving the hands 138. The connecting portion 1351 includes a first connecting portion connected to the hour hand and a second connecting portion connected to the minute hand. It may further include a third connecting portion connected to the second hand. The drive power generated in the drive unit 135 is configured to rotate the connecting portion 1351 at a preset angular speed. Especially, the angular speed of the second connecting portion connected to the minute hand is sixty times faster than that of the first connecting portion connected to the hour hand. Moreover, the angular speed of the third connecting portion connected to the second hand is sixty times faster than that of the first connecting portion connected to the hour hand. The angular speeds of the connecting portion 1351 can be realized by adjusting a gear ratio for rotating the connecting portions in the drive unit 135.

The window tape 132 is disposed between the touch window 131 and the bracket 133 and configured to bond the touch window 131 and the bracket 133 to each other. The display tape 134 is disposed between the bracket 133 and the display unit 151 to adhere the bracket 133 and the display unit 151 to each other. An adhesive material is coated on both surfaces of the window tape 132 and the display tape 134. The window tape 132 and the display tape 134 have a waterproof or dustproof function. Each of the window tape 132 and the display tape 134 has a preset width and is formed along an edge of the display unit 151. As shown in FIG. 4, the window tape 132 and the display tape 134 may have corresponding shapes and sizes to the bracket 133. In other words, if the bracket 133 is formed in a circular shape shown in FIG. 4, the window tape 132 and the display tape 134 are also formed in the circular shape. If the bracket 133 is formed in a rectangular shape, the window tape 132 and the display tape 134 are also formed in the rectangular shape.

Alternatively, each of the window and display tapes 132 and 134 may be formed in a ring shape with a penetrated center. If the predetermined width is too large, the tapes might be exposed outside the bracket 133 to deteriorate the external beauty of the mobile terminal module 130 and interfere in the user's view. If it is too small, the adhesive property becomes weaker enough to detach the touch window 131 and the bracket 133 or the bracket 133 and the display unit 151 from each other. Accordingly, the predetermined width may be determined according to the size and shape of the mobile terminal module 130 and the material used in forming the bracket 133. The optimal width capable of securing the user's view and the adhesiveness sufficiently may be determined based on experiments.

Figure 5:
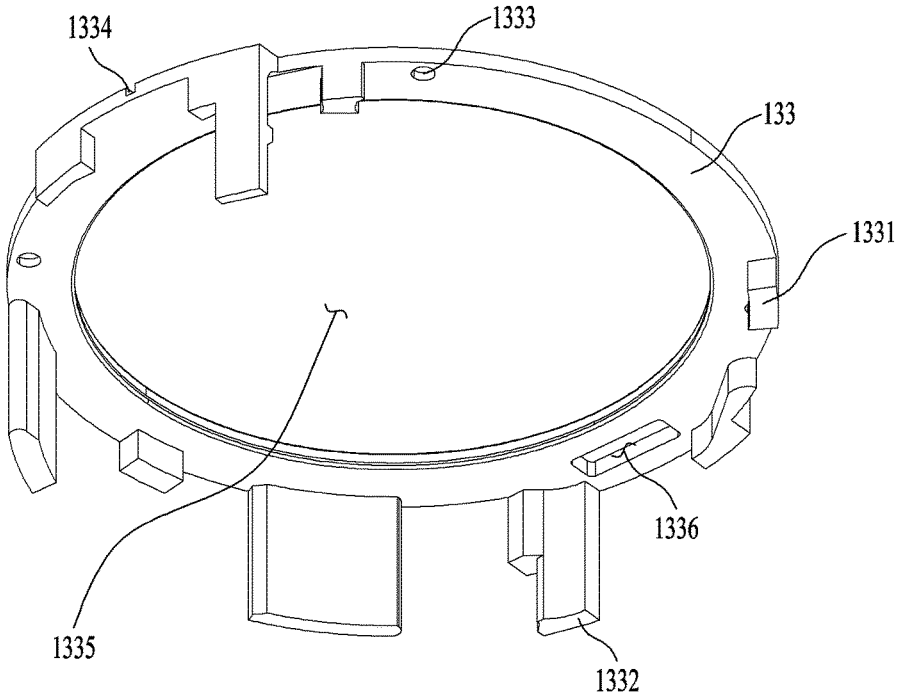
FIG. 5 is a perspective diagram of a bracket in accordance with one embodiment.

FIG. 5 is a perspective diagram of the bracket 133 in accordance with one embodiment.

The bracket 133 in accordance with the illustrated embodiment is located over the display unit 151 and configured to fixedly couple the frame 1356 and the display unit 151 to each other, as mentioned above. The bracket 133 shown in FIG. 5 may be corresponding to the display unit 151 in the shape and size. In other words, when the display unit 151 is formed in a circular shape shown in FIG. 4, the bracket 133 is also formed in the circular shape. When the display unit 151 is formed in a rectangular shape, the bracket 133 is also formed in the rectangular shape.

The center of the bracket 133 is penetrated to form a bracket hole 1335 so that the user's vision may not be interfered with when the user viewing the image information output on the display unit 151. Accordingly, the bracket 133 has a predetermined width and is formed in a direction along an edge of the display unit 151. If the predetermined width is too large, the bracket hole 1335 might become smaller enough to interfere with the user's field of vision. If it is too narrow, the durability of the mobile terminal module 130 might be deteriorated. Accordingly, the predetermined width may be determined according to the size and shape of the mobile terminal module 130 and the material used in forming the bracket 133. The optimal width capable of securing the user's view and the adhesiveness sufficiently may be determined based on experiments.

As shown in FIG. 5, the bracket 133 includes a guide portion 1332 and a second coupling portion 1331. The bracket 133 may further include at least one boss groove 1333. The guide portion 1332, the second coupling portion 1331 and the boss groove 1333 will be described in detail later.

Figure 6:
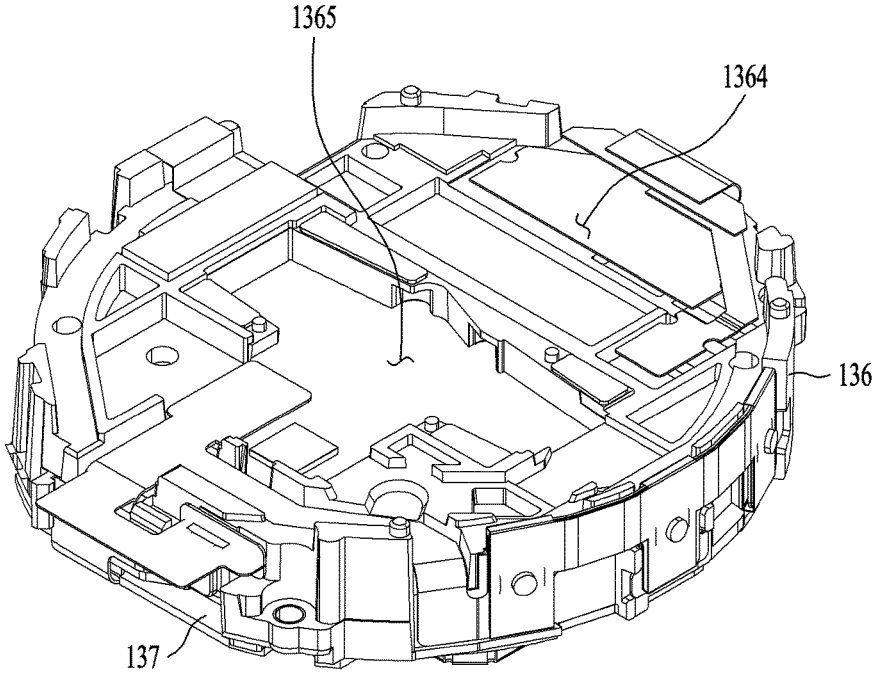
FIG. 6 is a perspective diagram of a frame in accordance with one embodiment.

FIG. 6 is a perspective diagram of the frame 136 in accordance with one embodiment.

The frame 136 in accordance with the embodiment shown in FIG. 6 may have a space 1364 provided in an upper portion thereof and the display unit 151 may be disposed in the space 1364. The space 1364 where the display unit 151 is disposed is corresponding to the display unit 151 in the size and the shape, to fix the display to the frame. In case the mobile terminal module 130 in accordance with the illustrated embodiment includes the hands (138, see FIG. 7), another space 1365 for accommodating the drive unit 135 configured to provide the drive power to the hands 138 may be further provided. The space 1365 for accommodating the drive unit 135 is corresponding to the drive unit 135 in the size and the shape so as to fixedly couple the drive unit 135 to the frame. If the power supply unit 190 is disposed in the inner portion of the frame 136 although not shown in the drawings, a space for accommodating the power supply unit 190 may be provided.

As mentioned above, the control board 137 may be coupled to the lower portion of the frame 136 and controls the operations of the other components. Accordingly, the frame 136 may function as the interface unit 160 for transmitting the control signal of the control board 137 to the other components. In other words, the frame 136 may include various input/output ports and buses.

The frame 136 is the body of the mobile terminal module 130 and defines the overall appearance of the mobile terminal module 130. In other words, the appearance of the mobile terminal module 130 may be changeable according to the appearance of the frame 136. In the illustrated embodiment shown in FIG. 6, the frame 136 may have a cylindrical shape and the embodiments are not limited thereto. The frame 136 may have diverse shapes, for example, a polygonal shape.

Figure 7:
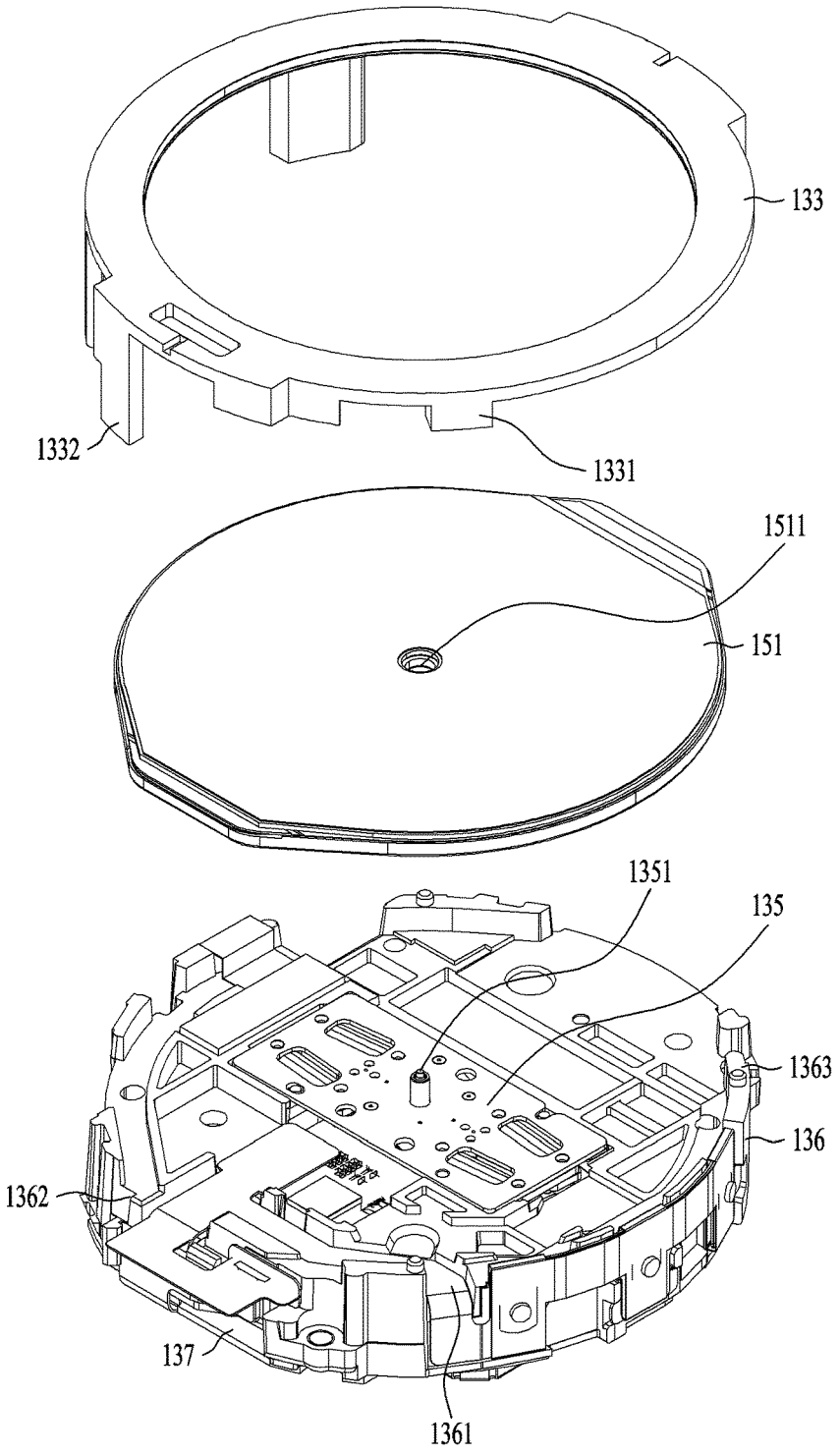
FIG. 7 is a diagram illustrating an assembling process of a bracket, a display unit and a frame in accordance with one embodiment.

FIG. 7 is a diagram illustrating an assembling process of the bracket, the display unit and the frame in accordance with one embodiment.

As shown in FIG. 7, the bracket 133 includes a guide portion 1332. The guide portion 1332 is longitudinally extended from an outer surface of the bracket 133 downward. It is preferred that a plurality of guide portions 1332 are formed. Not limited thereto, one guide portion may be formed as alternative example. Meanwhile, the frame 136 includes a slot 1362 corresponding to the guide portion 1332 in the size, the shape, the number and the location. The slot 1362 is recessed from an outer surface of the frame 136. As the guide portion 1332 is inserted in the slot 1362, the bracket 133 is coupled to the frame 136. Not limited to the slot recessed from the outer surface of the frame 136, the slot 1362 has a through hole as another example. In this instance, the guide portion 1332 may be longitudinally extended from an inner surface of the bracket 133, not the outer surface, downward. In other words, the guide portion and the slot 1362 may be formed in diverse ways, only when coupling the bracket 133 to the frame 136, with keeping its regular position.

As shown in FIG. 7, a first coupling portion 1361 is formed in the outer surface of the frame 136. It is preferred that a plurality of first coupling portions 1361 are formed. Not limited thereto, one first coupling portion may be formed. Meanwhile, the bracket 133 includes a second coupling portion 1331 corresponding to the first coupling portion 1361 in the size, the shape, the number and the location. The second coupling portion 1331 is extended from the outer surface of the bracket 133 downward. As the second coupling portion 1331 of the bracket 133 is coupled to the first coupling portion 1361 formed in the outer surface of the frame 137, the bracket 133 is coupled to the frame 136. In the embodiment, a hook may be formed in one of the first and second coupling portions 1361 and 1331 and a hooking portion may be formed in the other one. Not limited thereto, a hook may be formed in one of the first and second coupling portions 1361 and 1331 and a ring may be formed in the other one. Moreover, a locking wing may be formed in one of them and a locking protrusion may be formed in the other. More specifically, the first and second coupling portions 1361 and 1331 may be formed in various ways, only if fixedly coupling the bracket 133 and the frame 136 to each other.

Figure 8:
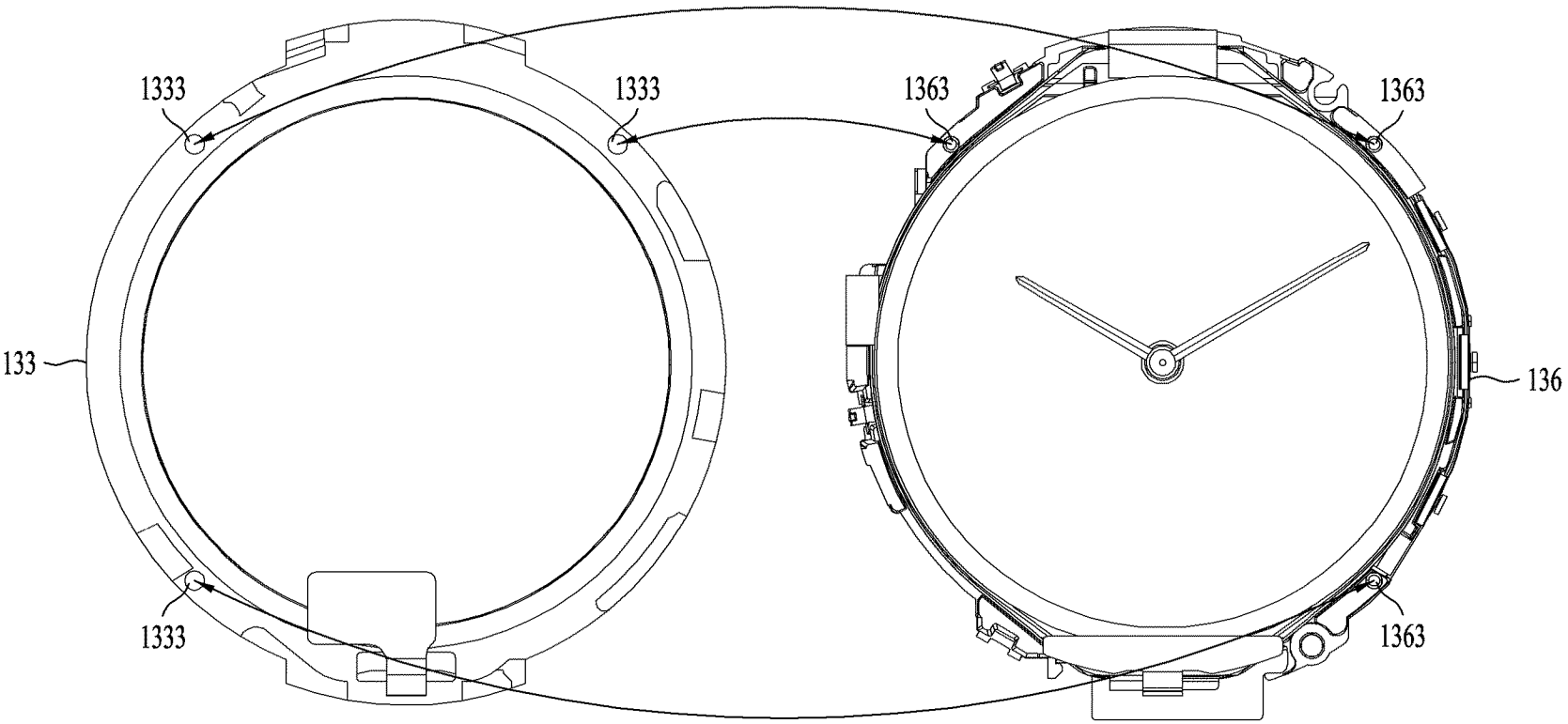
FIG. 8 is a diagram illustrating a coupling relation between a lower surface of the bracket and an upper surface of the frame in accordance with one embodiment.

FIG. 8 is a diagram illustrating a coupling relation between the lower surface of the bracket 133 and the upper surface of the frame 136 in accordance with one embodiment.

As shown in FIGS. 7 and 8, a boss 1363 may be projected from a top of the frame 136 upward. It is preferred that a plurality of bosses 1363 are formed. Not limited thereto, one boss may be formed. Meanwhile, a boss groove 1333 is recessed in the frame 136 and the boss groove 1333 is corresponding to the boss 1363 in the size, the shape, the number and the location. As the boss 1363 of the frame 136 is inserted in the boss groove 1333 of the bracket 133, the bracket 133 and the frame 136 are coupled to each other. Not limited thereto, the boss 1363 may be formed in a lower portion of the bracket 133 and the boss groove 1333 may be formed in an upper portion of the frame 136. The boss 1363 shown in FIG. 7 has a dome shape. Not limited thereto, the boss 1363 may have diverse shapes such as a cylindrical shape and a polygonal shape.

Figure 9:
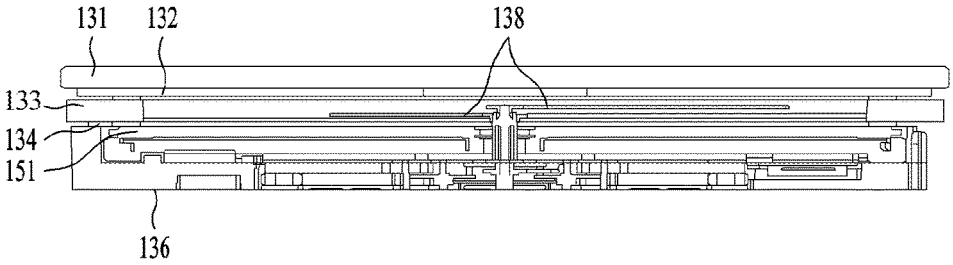
FIG. 9 is a sectional diagram of the mobile terminal module cut away along A-A' of FIG. 3.

FIG. 9 is a sectional diagram of the mobile terminal module 130 cut away along A-A' from FIG. 3.

When the mobile terminal module 130 includes the hands 138, the touch window 131 is spaced a preset distance apart from the display nit 151 as mentioned above. Accordingly, the predetermined space may be provided between the touch window 131 and the display unit 151 and the hands 138 move in such the predetermined space.

As shown in FIG. 9, the bracket 133 is disposed between the touch window 131 and the display unit 151 to arrange the touch window 131 distant from the display unit 151. The window tape 132 is disposed between the touch window 131 and the bracket 133 and the display tape 134 is disposed between the bracket 133 and the display unit 151. Each of the window tape 132, the bracket 133 and the display tape 134 may have a predetermined thickness. According to the thicknesses, the distance or height between the touch window 131 and the display 151 may be variable and the size of the predetermined space may be also variable. When the total thickness of the window tape 132, the bracket 133 and the display tape 134 is too thick, the user's touching sensation might be deteriorated. More specifically, the position to which the user applies touch input on the touch window 131 does not match the position the recognized touch input is displayed on the display unit 151, so that the user may feel a sense of difference. In contrast, when the total thickness is too thin, the hands 138 or the connecting portions of the hands 138 might contact with an inner surface of the touch window 131 and interfere with the movement of the hands 138. Accordingly, the total thickness may be determined based on the size and shape of the mobile terminal module 130, the user's touching sensation, the size of the hands 138 and the size of the connecting portion. The optical thickness is determined based on experiments to secure the user's touching sensation and not to interfere with the movement of the hands 138.

Figure 10:
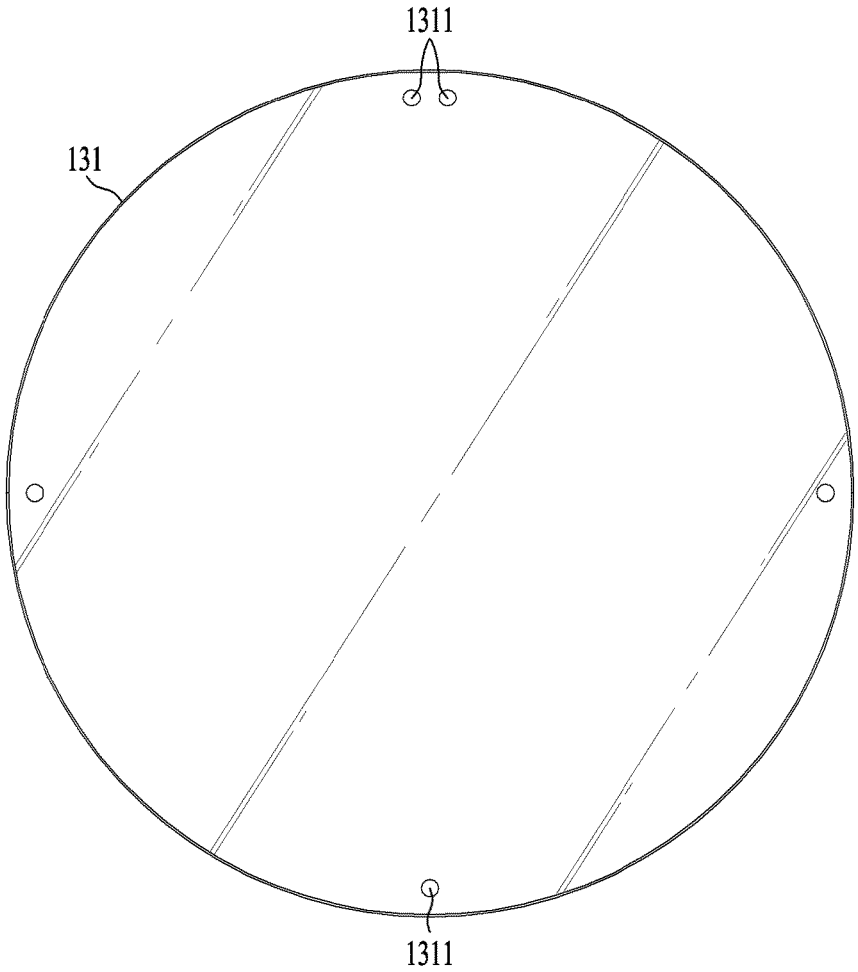
FIG. 10 is a front view of a touch window in accordance with one embodiment.
Figure 11:
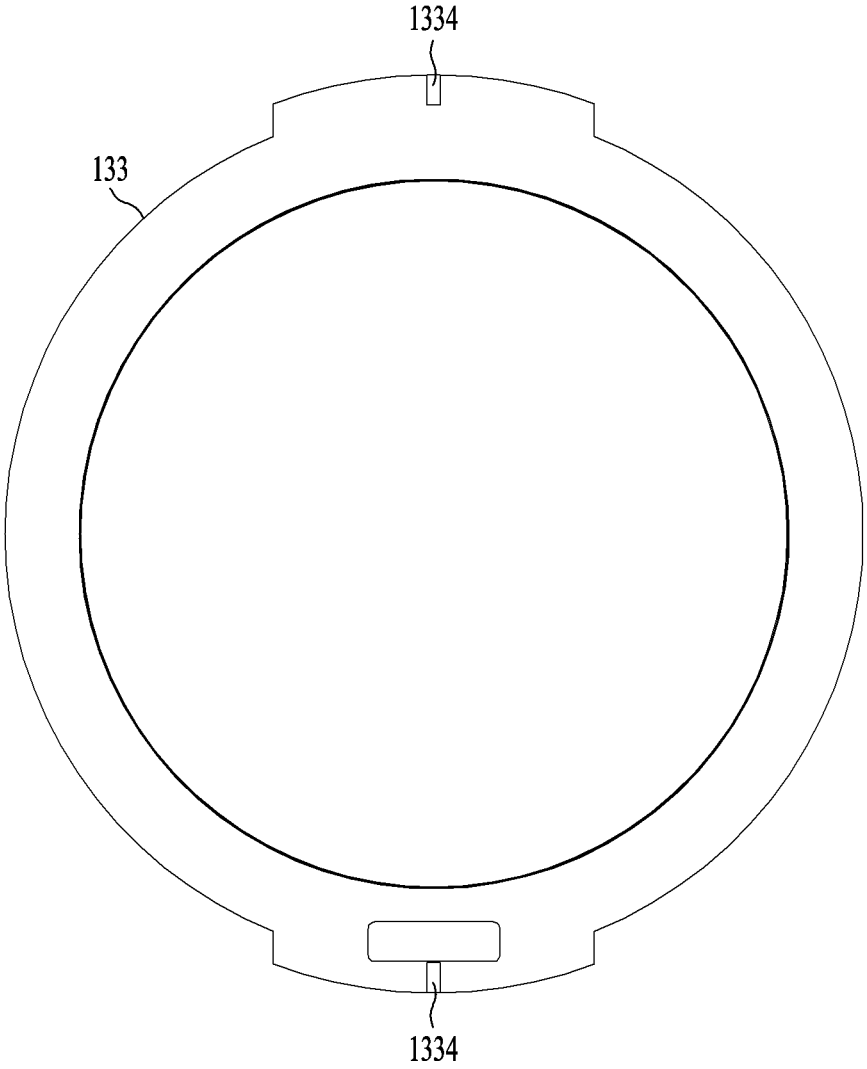
FIG. 11 is a front view of a bracket in accordance with one embodiment.
Figure 12:
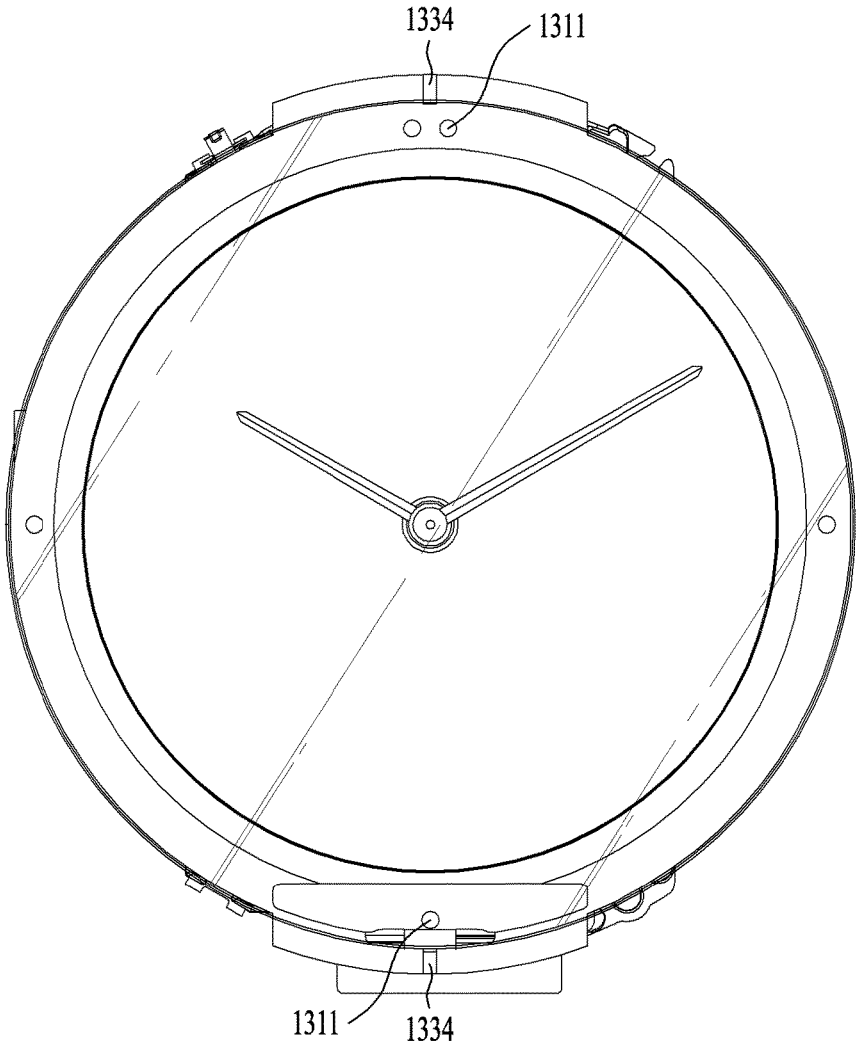
FIG. 12 is a front view of the mobile terminal module in accordance with one embodiment.

FIG. 10 is a front view of the touch window 131 in accordance with one embodiment. FIG. 11 is a front view of the bracket 133 in accordance with one embodiment. FIG. 12 is a front view of the mobile terminal module 130 in accordance with one embodiment.

A first reference portion 1311 is formed on an upper surface of the touch window shown in FIG. 10. A second reference portion 1334 is formed in an upper surface of the bracket 133 shown in FIG. 11. The first and second reference portions 1311 and 1334 may be simply displayed on surfaces of the touch window 131 and the bracket 133, respectively, in a specific shape. Not limited thereto, the first and second reference portions 1311 and 1334 may be projected or recessed in a specific shape.

The first and second reference portions 1311 and 1334 may be formed in a direction which points to twelve and six o'clock on the mobile terminal module 130, respectively. Alternatively, the first and second reference portions 1311 and 1334 may be further formed in a direction which points to three o'clock and nine o'clock. Moreover, they may be formed in all directions which point to one o'clock through twelve o'clock.

The first reference portion 1311 formed in the touch window 131 and the second reference portion 1334 formed in the bracket 133 may be corresponding to each other in the number and interval. Accordingly, when the touch window 131 adheres to the bracket 133, the first reference portion 1311 adheres to be located at a position corresponding to the second reference portion 1334 and the touch window 131 is able to adhere to its regular position, without losing directivity. In case one of the first and second reference portions 1311 and 1334 has a projected shape, the other one may have a recessed shape to be corresponding in the size, the shape, the number and the location. As one of the first and second reference portions 1311 and 1334 is inserted in the other one, the touch window 131 may adhere to the regular position.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A mobile terminal module comprising:

a display unit for displaying an image;

a frame having the display unit disposed in an upper portion thereof and comprising a first coupling portion;

a bracket disposed in an upper portion of the display unit and comprising a second coupling portion coupled to the first coupling portion to fix the display unit and the frame;

a control board fixedly coupled to the frame or the bracket and configured to control an operation of the display unit;

a power supply unit fixedly coupled to the frame or the bracket and configured to supply electric power to the display unit and the control board;

a touch window fixed to an upper surface of the bracket and configured to recognize touch input;

hands disposed in an upper portion of the display unit, the hands configured to move to point to a current time as time passes;

a display tape disposed between the bracket and the display unit and having adhesiveness on both surfaces thereof; and a window tape disposed between the touch window and the bracket and having adhesiveness on both surfaces thereof, wherein the display tape and the window tape each have a shape and a size corresponding to a shape and size of the bracket, and wherein the bracket is configured to form a predetermined space between the display unit and the touch window for the hands to move in the predetermined space.

2. The mobile terminal module of claim 1, wherein one of the first and second coupling portions is formed as a hook and the other one is formed as a hooking portion to which the hook is hooked.

3. The mobile terminal module of claim 1, wherein the first coupling portion is formed in a lateral surface of the frame.

4. The mobile terminal module of claim 1, wherein the bracket comprises at least one guide portion extended from an outer surface downward, wherein a slot is formed in a lateral surface of the frame and corresponding to the guide portion in the size and the shape, and wherein the bracket is coupled to an upper portion of the display unit as the guide portion is inserted in the slot.

5. The mobile terminal module of claim 1, wherein at least one boss is projected from an upper surface of the frame upward, wherein a boss groove is recessed from a lower surface of the bracket and corresponding to the boss in the size and the shape, and wherein the frame is coupled to an upper portion of the display unit as the boss is inserted in the boss groove.

6. The mobile terminal module of claim 1, further comprising:

a drive unit configured to supply a drive power to the hands.

7. The mobile terminal module of claim 6, wherein a distance or height from the upper surface of the display unit to the touch window is larger than a distance or height of a connecting portion for connecting the hands to the drive unit.

8. The mobile terminal module of claim 1, wherein at least one first reference portion is displayed on an upper surface of the touch window, wherein at least one second reference portion is formed in an upper surface of the bracket, and wherein the touch window is fixedly coupled to the upper surface of the bracket as the first reference portion is located in a corresponding position to the second reference portion.

9. A watch type mobile terminal comprising:

a mobile terminal module comprising:

a display unit for displaying an image;

a frame having the display unit disposed in an upper portion thereof and comprising a first coupling portion;

a bracket disposed in an upper portion of the display unit and comprising a second coupling portion coupled to the first coupling portion to fix the display unit and the frame;

a control board fixedly coupled to the frame or the bracket and configured to control an operation of the display unit;

a power supply unit fixedly coupled to the frame or the bracket and configured to supply electric power to the display unit and the control board;

a touch window fixed to an upper surface of the bracket and configured to recognize touch input;

hands disposed in an upper portion of the display unit, the hands configured to move to point to a current time as time passes;

a display tape disposed between the bracket and the display unit and having adhesiveness on both surfaces thereof; and a window tape disposed between the touch window and the bracket and having adhesiveness on both surfaces thereof, wherein the display tape and the window tape each have a shape and a size corresponding to a shape and size of the bracket, and wherein the bracket is configured to form a predetermined space between the display unit and the touch window for the hands to move in the predetermined space, a first housing comprising an accommodating space for accommodating the mobile terminal module;

a second housing coupled to the first housing and covering the accommodating space; and a strap connected to the first housing and winding a user's wrist.

10. The watch type mobile terminal of claim 9, wherein the first coupling portion is formed in a lateral surface of the frame.

11. The watch type mobile terminal of claim 9, wherein the bracket comprises at least one guide portion extended from an outer surface downward, wherein a slot is formed in a lateral surface of the frame and corresponding to the guide portion in the size and the shape, and wherein the bracket is coupled to an upper portion of the display unit as the guide portion is inserted in the slot.

12. The watch type mobile terminal of claim 9, wherein at least one boss is projected from an upper surface of the frame upward, wherein a boss groove is recessed from a lower surface of the bracket and corresponding to the boss in the size and the shape, and wherein the frame is coupled to an upper portion of the display unit as the boss is inserted in the boss groove.

13. The watch type mobile terminal of claim 9, further comprising:

a drive unit configured to supply a drive power to the hands, wherein the distance or height from the upper surface of the display unit to the touch window is larger than that of a connecting portion for connecting the hands to the drive unit.

* * * * *